US007438142B2

(12) United States Patent
Butler et al.

(10) Patent No.: US 7,438,142 B2
(45) Date of Patent: Oct. 21, 2008

(54) RECOVERY SYSTEM

(75) Inventors: Frank Butler, Houston, LA (US); Tim Browning, Metairie, LA (US)

(73) Assignee: M-I LLC, Houston, TX (US)

( * ) Notice: Subject to any disclaimer, the term of this patent is extended or adjusted under 35 U.S.C. 154(b) by 202 days.

(21) Appl. No.: 11/387,442

(22) Filed: Mar. 23, 2006

(65) Prior Publication Data

US 2007/0221410 A1 Sep. 27, 2007

(51) Int. Cl.
*E21B 21/06* (2006.01)

(52) U.S. Cl. ..... 175/66; 175/206

(58) Field of Classification Search ..... 175/65, 175/66, 72, 206, 207
See application file for complete search history.

(56) References Cited

U.S. PATENT DOCUMENTS 4,482,459 A * 11/1984 Shiver ..... 210/639
6,138,834 A 10/2000 Southall
6,881,349 B2 * 4/2005 Mueller ..... 210/708
6,892,887 B2 5/2005 Rayborn
7,004,333 B2 2/2006 Marcotullio et al.
7,077,319 B2 * 7/2006 Schnee et al. ..... 235/462.1
2004/0094483 A1 * 5/2004 Mueller ..... 210/708

OTHER PUBLICATIONS

United States office Action in Corresponding U.S. Appl. No. 11/535,028 (10 pages).

* cited by examiner

*Primary Examiner*—George Suchfield
(74) *Attorney, Agent, or Firm*—Osha Liang, LLP

(57) ABSTRACT

A process for the recovery of industrial carbon material from a mixture. The mixture may include drilling fluids, drilled solids, and industrial carbon from a mud system. The process may include: separating at least a portion of the drilled solids from the mixture to form a first effluent and a drilled solids fraction; separating at least a portion of the industrial carbon from the first effluent to form a second effluent and a recovered industrial carbon fraction; and recycling at least a portion of the recovered industrial carbon to the mud system.

23 Claims, 7 Drawing Sheets

RECOVERY SYSTEM

BACKGROUND OF INVENTION

1. Field of the Invention

The invention relates generally to drilling muds, loss circulation materials, industrial materials, and processes to recover the industrial materials for reuse in drilling mud systems.

2. Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for implacing a packer, abandoning the well or preparing the well for abandonment, and otherwise treating the well or the formation.

Drilling fluids or muds typically include a base fluid (water, diesel or mineral oil, or a synthetic compound), weighting agents (most frequently barium sulfate or barite is used), bentonite clay to help remove cuttings from the well and to form a filter cake on the walls of the hole, lignosulfonates and lignites to keep the mud in a fluid state, and various additives that serve specific functions, such as polymers, corrosion inhibitors, emulsifiers, and lubricants.

During drilling, the mud is injected through the center of the drill string to the bit and exits in the annulus between the drill string and the wellbore, fulfilling, in this manner, the cooling and lubrication of the bit, casing of the well, and transporting the drill cuttings to the surface. At the surface, the mud can be separated from the drill cuttings for reuse, and the drill cuttings can be disposed of in an environmentally accepted manner.

Recycling drilled solids into the wellbore is undesirable, as this can result in smaller sizes of drilled solids which can accumulate in the drilling fluid. If the solids content increases, additional drilling fluid (water, oil, etc.) must be added to maintain the mud at its desired weight. The drilling mud and drill cuttings returned to the surface are often separated to maintain drilling mud weight, thus avoiding costly dilution. The separated solids are then discarded or disposed of in an environmentally accepted manner.

Drill cuttings can originate from different geological strata, including clay, rock, limestone, sand, shale, underground salt mines, brine, water tables, and other formations encountered while drilling oil and gas wells. Cuttings originating from these varied formations can range in size from less than two microns to several hundred microns. Drill cuttings are commonly classified according to size: smaller than 2 microns are classified as clay; from 2 to 74 microns, silt; 74 to 500 microns, sand; and larger than 500 microns, cuttings. Several types of separation equipment have been developed to efficiently separate the varied sizes of the weighting materials and drill cuttings from the drilling fluid, including shakers (shale, rig, screen), screen separators, centrifuges, hydrocyclones, desilters, desanders, mud cleaners, mud conditioners, dryers, filtration units, settling beds, sand traps, and the like.

Centrifuges and like equipment can speed up the separation process by taking advantage of both size and density differences in the mixture being separated.

A typical process used for the separation of drill cuttings and other solids from drilling fluid is shown in FIG. 1, illustrating a stage-wise separation according to the size classifications. Drilling mud 2 returned from the well (not shown) and containing drill cuttings and other additives can be separated in a shale shaker 4, resulting in large particles 5, such as drill cuttings (greater than 500 microns for example), and effluent 6. The drilling fluid and remaining particles in effluent 6 can then be passed through a degasser 8; a desander 10, removing sand 15; a desilter 12, removing silt 16; and a centrifuge 14, removing even smaller particles 17, such as clay. The solids 15, 16, 17 separated, including any weighting materials separated, are then discarded and the clean drilling fluid 18 can be recycled to the mud mixing system (not shown). Agitated tanks (not numbered) can be used between separation stages as holding/supply tanks.

The recovered, clean mud can be recycled, however the mud formulation must often be adjusted due to compounds lost during the drilling process and imperfect separation of drill cutting particles and other drilling fluid additives. As examples of imperfect separations, drilling fluid can be absorbed or retained with drill cuttings during separation; conversely, drill cuttings having a small size can remain with the drilling mud after separations. Losses during the drilling process can occur due to the mud forming a filter cake, and thus depositing drill fluid additives on the wall of the wellbore.

Formation of a filter cake along the wall of the wellbore can occur throughout the drilling process, where drilling additives are used on a continuous basis. Filter cake formation can also be purposeful, such as in areas where drilling fluid circulation is lost. Lost circulation can occur in porous strata, requiring use of loss control additives to seal the openings in the formation, preventing loss of drilling fluids to the permeable formation and regaining drilling fluid circulation. Various agents and additives are known in the art to form formation seals and/or filter cakes on the wall of a well bore. These include sugar cane fibers or bagasse, flax, straw, ground hemp, cellophane strips, ground plastics, ground rubber, mica flakes, expanded perlite, silica slag, ground fir bark, ground redwood bark and fibers, grape extraction residue, cottonseed hulls, cotton balls, ginned cotton fibers, cotton linters, superabsorbent polymers, cellulose fibers, lignite, industrial carbon or graphite, and the like.

The formation of a filter cake along the wellbore may increase the stability of the wellbore. Additionally, use of certain additives, such as industrial carbon, in a loss control pill or throughout the drilling cycle can stabilize shale formations and other sections encountered while drilling. Improved wellbore stability can reduce the occurrence of stuck pipe, hole collapse, hole enlargement, and lost circulation and can improve well control.

While desiring improved wellbore stability, logistics and economics disfavor the use of industrial carbon throughout the entire drilling process. The disposal of the solids separated when cleaning the mud, including the industrial carbon, significantly increases the total amount of industrial carbon needed for the desired filter cake formation. The amount of industrial carbon thus required can increase the costs of drilling, and can require an excessive amount of storage space on a rig.

As an alternative to discarding all of the separated solids, a process of recovering and recycling polymer beads, which may be used as an additive in drilling fluids, has been contemplated. For example, U.S. Pat. No. 6,892,887 discloses a process for the separation and recovery of polymer beads from drilling mud, where a mixture of solid particulate materials, drilling fluids, polymer beads, and drilled solids are first passed through a shale shaker and/or a 10 mesh screen recovery apparatus; the large solid materials are discarded; and the remaining materials are passed through a hydrocyclone and a recovery shaker to separate the polymer beads and the fluids.

Polymer beads generally have a uniform size, i.e. spherical particles having a narrow particle size distribution, and have a significantly lower density, 0.8 to 1.4 g/cc, than the drilled solids and drill cuttings, approximately 2.6 g/cc. Additionally, polymer beads do not comminute or break down into smaller particles as readily as drill cuttings and other additives used in drilling fluids. These distinguishing properties facilitate the above recovery process.

It is desired in the industry to recover and recycle other drilling fluid additives, including industrial carbon. However, in contrast to polymer beads, the industrial carbon materials that are desired to be used throughout the drilling process are commonly supplied as particles, of varying particle sizes, uniformity, and shape. Additionally, the drill cuttings and formations encountered during drilling can return particles of similar shape and size to that of industrial carbon, and can comminute during circulation through the drill string, each of which can hinder recovery and recycle efforts.

Accordingly, there exists a need for a process useful in separating industrial carbon materials from drilling fluids and drill cuttings returned from the wellbore.

SUMMARY OF INVENTION

In one aspect, embodiments disclosed herein relate to a process for the process for the separation and recovery of industrial carbon from drilling fluids. In other aspects, embodiments disclosed herein relate to a process for the recovery and recycle of industrial carbon from drilling fluids.

Embodiments disclosed herein relate to a process for the recovery of industrial carbon material from a mixture. The mixture may include drilling fluids, drilled solids, and industrial carbon from a mud system. The process may include: separating at least a portion of the drilled solids from the mixture to form a first effluent and a drilled solids fraction; separating at least a portion of the industrial carbon from the first effluent to form a second effluent and a recovered industrial carbon fraction; and recycling at least a portion of the recovered industrial carbon to the mud system.

Other embodiments disclosed herein relate to a process for the recovery of industrial carbon from a mixture. The mixture may include drilling fluids, drilled solids, and industrial carbon from a mud system. The process may include: separating a first portion of the drilled solids from the mixture to form a first effluent and a drilled solids fraction; separating a second portion of the drilled solids from the first effluent to form a second effluent and a second drilled solids fraction; separating at least a portion of the industrial carbon from the second effluent to form a third effluent and a recovered industrial carbon fraction; recycling at least a portion of the recovered industrial carbon to the active mud system.

Embodiments disclosed herein relate to an apparatus for the recovery of industrial carbon material from a mixture. The apparatus may include: means for separating at least a portion of the drilled solids from the mixture to form a first effluent and a drilled solids fraction; means for separating at least a portion of the industrial carbon from the first effluent to form a second effluent and a recovered industrial carbon fraction; and means for recycling at least a portion of the recovered industrial carbon to the active mud system.

DETAILED DESCRIPTION

In one aspect, embodiments disclosed herein relate to a process for the separation and recovery of industrial carbon from drilling fluids. In another aspect, embodiments disclosed herein relate to a process for the recovery and recycle of industrial carbon from drilling fluids.

As used herein, industrial carbon may refer to coal, lignite, industrial carbon, natural graphite, graphite flakes, graphite fibers, synthetic graphite, coke, calcined petroleum, calcined pitch, semi-graphitized coke, metallurgical coke, petroleum coke, carbon fibers, solid graphite, pelletized carbons, and the like.

Figure 1:
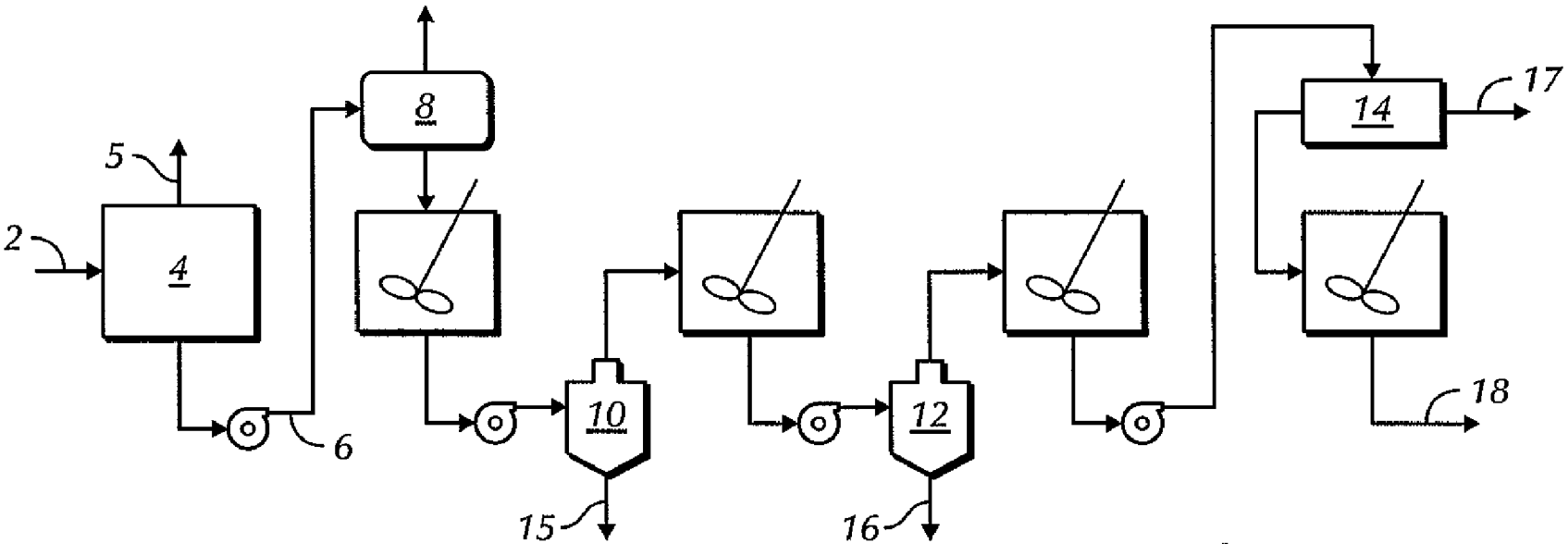
FIG. 1 (Prior Art)
FIG. 1 (prior art) is a simplified flow diagram of a prior art process for cleaning drilling mud.
Figure 2:
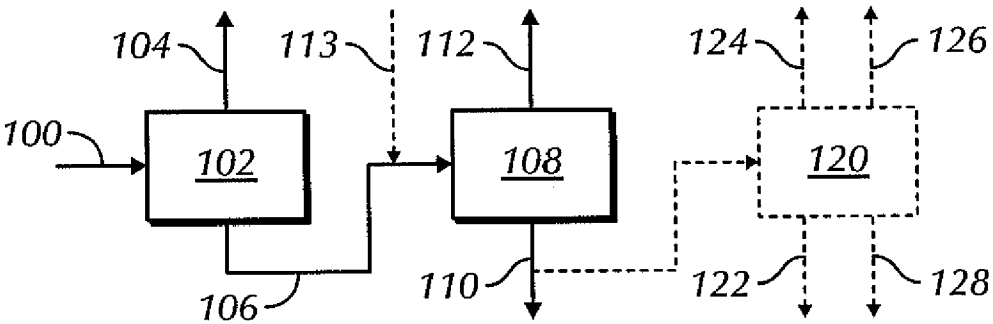
FIG. 2 is a simplified flow diagram of embodiments of the process to recover industrial carbon from drilling mud described herein.

Referring to FIG. 2, one embodiment of a process for the separation and recovery of industrial carbon material from drilling mud is shown. FIG. 2 presents a general flow diagram showing a simplified version of the process. One of ordinary skill in the art would recognize that additional equipment including vessels, pumps, augers, valves, and the like may be required for the process, although not shown.

Drilling mud, containing industrial carbon and other additives such as weighting materials, as needed, circulates down through the drill pipe or drill string, out the drill bit, picks up drill cuttings, and the mixture circulates back to the surface (not shown). The combined mud 100, a mixture containing drill cuttings, drilling fluid, industrial carbon, and other additives, is fed to a first separator 102, which separates the combined mud 100 into particles 104 and first effluent 106.

First separator 102 may include one or more shakers, screen separators, centrifuges, hydrocyclones, filtration systems, or the like, or combinations thereof. First separator 102 may separate large particles from combined mud 100. In some embodiments, first separator 102 separates a fraction of the drill cuttings and other drilling mud components having an average particle size greater than an average particle size of the industrial carbon in combined mud 100 such that at least a fraction of the industrial carbon may remain with first effluent 106, along with other particles not separated in first separator 102. In other embodiments, a majority of the industrial carbon may remain with first effluent 106.

First effluent 106 may be recovered from first separator 102 and transported to a second separator 108, where first effluent 106 can be separated into second effluent 110 and industrial carbon fraction 112. Second separator 108 may include one or more screen separators, centrifuges, hydrocyclones, dryers, hydrocyclone shakers, or combinations thereof, for example. In other embodiments, second separator 108 may also include a vertical centrifuge, a shaker, a filtration system, a mud cleaner, or the like. In embodiments, second separator 108 may separate an industrial carbon fraction 112 which includes particles having an average particle size similar to that of the industrial carbon added to the mud system. In this manner, a majority of the industrial carbon can be recovered from combined mud 100.

First effluent 106 may be optionally diluted with an internal olefin stream 113 prior to being fed to second separator 108. Internal olefin stream 113 may be used to lower the viscosity of first effluent 110, potentially enhancing the separations achieved in second separator 108.

Industrial carbon fraction 112, which may include industrial carbon and other particles of similar size, may be recycled to the mud system as needed, or may undergo further processing. Second effluent 110 may also be recycled to the mud system, as second effluent 110 has been cleaned of large particle size drill cuttings and other particles in separators 102, 108.

Alternatively, second effluent 110 may be further processed to recover smaller particles, such as barite, polymer beads, or other additives. For example second effluent 110 may be fed to one or more additional separators 120, which may include centrifuges, desanders, desilters, mud cleaners, screen separators, shakers, hydrocyclones, or the like, and combinations thereof. The processing of second effluent 110 through separators 120 may result in one or more recovered materials such as clay 122, sand 124, silt 126, and clean drilling fluid 128. Clay 122, clean drilling fluid 128 and any other additives recovered from additional separators 120 can be recycled to the mud system, as needed.

Components recovered in particles 104, sand 124, and silt 126 may be combined for disposal, further processing, or other various uses. These streams (104, 124, and 126) may also be processed independent of one another. Where additional removal of organic materials is required, the recovered particles may be thermally or chemically treated. Useful end products may also be formed from the particles 104, sand 124, and silt 126. For example, where particles 104, sand 124, and/or silt 126 contain drill cuttings from strata comprised of various clays (such as smectite clays, attapulgite clays, kaolin clays, and others), the recovered particles may be further processed to form supports, catalysts, activated clays, or other useful products.

Figure 3:
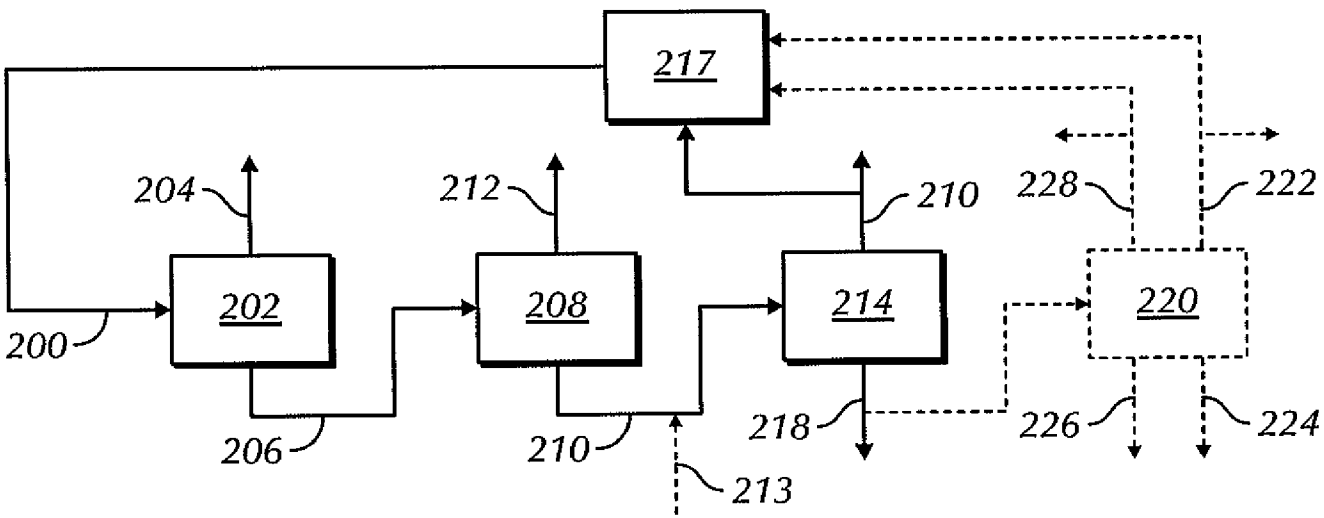
FIG. 3 is a simplified flow diagram of embodiments of the process to recover industrial carbon from drilling mud described herein.

Referring now to FIG. 3, another embodiment of a process for the separation and recovery of industrial carbon material from drilling mud is shown. Drilling mud, containing industrial carbon and other additives as needed, circulates down through the drill pipe or drill string, out the drill bit, picks up drill cuttings, and circulates back to the surface (not shown). The mixture 200, containing drilling mud, industrial carbon, drill cuttings, and other particles, is fed to a first separator 202, which separates the combined mud 200 into first particle fraction 204 and first effluent 206.

First separator 202 may be a shaker, screen separator, centrifuge, hydrocyclone, filtration system, or the like, or combinations thereof. First separator 202 may separate first particle fraction 204 having particles of 5000 microns and greater from combined mud 200 in some embodiments; 2000 microns or greater in other embodiments; 1000 microns or greater in other embodiments; 500 microns or greater in yet other embodiments. Those having ordinary skill in the art will recognize that these sizes are exemplary only. In embodiments, first separator 202 separates a first particle fraction 204 including drill cuttings and other similarly sized drilling mud components from mixture 200, and a majority of the industrial carbon will remain with first effluent 206.

First effluent 206, including any particles not separated and recovered with first particle fraction 204, may be recovered from first separator 202 and transported to second separator 208, where second effluent 210 may be separated from second particle fraction 212. Second separator 208 may be a centrifuge, such as a vertical centrifuge, for example. In other embodiments, second separator 208 may include a centrifuge, a hydrocyclone, a dryer, a shaker, a screen separator, a filtration system, or the like, or combinations thereof.

Second separator 208 may separate second particle fraction 212 having an average particle size of 2000 microns and greater from first effluent 206 in some embodiments; 1000 microns or greater in other embodiments; 500 microns or greater in other embodiments; 400 microns or greater in other embodiments; 250 microns or greater in yet other embodiments. In various embodiments, second separator 208 may separate a second particle fraction 212 including drill cuttings and other similarly sized drilling mud components from combined first effluent 206, where at least a fraction of the industrial carbon may remain with second effluent 210; in other embodiments, a majority of the industrial carbon may remain with second effluent 210. The fraction of the industrial carbon remaining with second effluent 210 can depend upon certain factors, including the size and size distribution of the industrial carbon, as well as the type, cut point, and efficiency of the separation device(s) employed, among others.

In some embodiments, second separator 208 may separate second particle fraction 212 and second effluent 210 based upon density. Drill cuttings and industrial carbon or graphite may have different densities, ranging from slightly different to vastly different depending upon the strata being drilled. Density gradient centrifugation may advantageously be used to separate the drill cuttings from second effluent based upon density, minimizing the amount of drilled solids in second effluent 210. Float-sink separations may also be employed to separate the components based upon density.

Second effluent 210 may be subsequently fed to third separator 214, where industrial carbon fraction 216 may be separated from third effluent 218. Second effluent 210 may be optionally diluted with an internal olefin stream 213. Internal olefin stream 213 can be used to lower the viscosity of second effluent 210, potentially enhancing the separations achieved in third separator 214.

Third separator 214 may be a shaker, hydrocyclone, screen separator, mud cleaner, centrifuge, filtration system, or the like, or combinations thereof, and can employ size exclusion separation techniques, density separation techniques, or both. Third separator 214 may separate industrial carbon fraction 216 having an average particle size of 1000 microns or greater from second effluent 210; 500 microns or greater in other embodiments; 250 microns or greater in other embodiments; 75 microns or greater in other embodiments; 2 microns or greater in yet other embodiments. In other embodiments, third separator 214 may separate an industrial carbon fraction 216, which may include industrial carbon and other particles of similar size, from second effluent 210. Smaller particles, such as clay and other additives, may remain suspended in third effluent 218.

Similarly, the fraction of the industrial carbon separated from third effluent 218 can depend upon certain factors, including the size and size distribution of the industrial carbon, as well as the type, cut point, and efficiency of the separation device(s) employed, among others. In embodiments, industrial carbon fraction 216 may be at least 50 weight percent industrial carbon. In other embodiments, industrial carbon fraction 216 may be at least 70 weight percent industrial carbon; at least 80 percent in other embodiments; 90 weight percent in other embodiments; and 95 weight percent in yet other embodiments.

Industrial carbon fraction 216, which may include industrial carbon and other particles of similar size, may be recycled to the mud system 217, as needed, or may undergo further processing as described below. Third effluent 218 may also be recycled to the mud system 217, as third effluent 218 has been cleaned of large particle size drill cuttings and other particles in first separator 202, second separator 208, third separator 214, and any further separation processes employed.

Optionally, third effluent 218 can be further processed to recover smaller particles, such as barite, polymer beads, or other additives. For example, third effluent 218 can be fed to one or more additional separators 220, which may include centrifuges, desanders, desilters, mud cleaners, screen separators, shakers, hydrocyclones, or the like, or combinations thereof. The processing of third effluent 218 through separators 220 may result in one or more recovered materials such as clay 222, sand 224, silt 226, and clean fluid 228. Clay 222, clean fluid 228 and any other additives recovered from additional separators 220 can be recycled to the mud system 217, as needed for control of mud properties such as weight and viscosity, among others. As above, first particle fraction 204, second particle fraction 212, sand 224, and silt 226 can be disposed of or processed further, individually or in combination.

Figure 4:
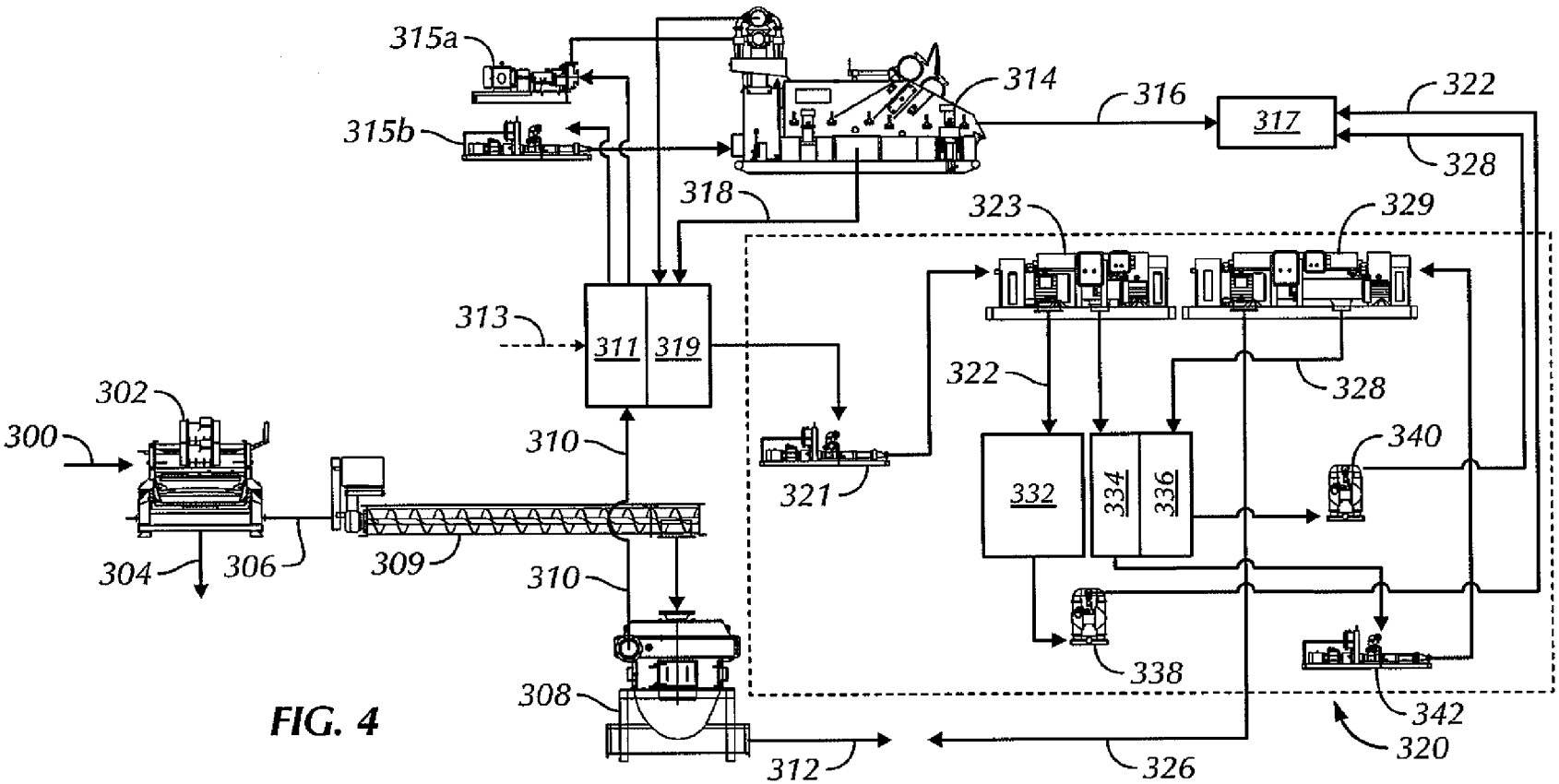
FIG. 4 is a simplified flow diagram of embodiments of the process to recover industrial carbon from drilling mud described herein.

Referring now to FIG. 4, another embodiment of a process for the separation and recovery of industrial carbon material from drilling mud is shown. Drilling mud, containing industrial carbon and other additives as needed, circulates down through the drill pipe or drill string, out the drill bit, picks up drill cuttings, and circulates back to the surface (not shown). The mixture 300, containing drilling mud, industrial carbon, drill cuttings, and other particles, is fed to one or more rig shakers 302, which separates the combined mud 300 into a first drill cuttings fraction 304 and first effluent 306.

First separator 302 may separate a first drill cuttings fraction 304 having particles of 5000 microns and greater from mixture 300 in some embodiments; 2000 microns or greater in other embodiments; 1000 microns or greater in other embodiments; 500 microns or greater in yet other embodiments. In embodiments, rig shakers 302 separates a first drill cuttings fraction 304 including drill cuttings and other similarly sized drilling mud components from combined mud 300.

First effluent 306, including any particles not separated and recovered with first drill cuttings fraction 304, may be recovered from rig shakers 302 and transported to centrifuge 308 using augur 309. Second effluent 310 may be separated from second drill cutting fraction 312 in centrifuge 308. Centrifuge 308 may be a vertical centrifuge, such as a VERTI-G™ cuttings dryer (available from MI-SWACO, Houston, Tex.), for example. Drill cuttings fractions 304, 312 may be disposed of or used as described above. In other embodiments, centrifuge 308 may be a horizontal centrifuge, such as a MUD-10 centrifuge (available from BRANDT, a VARCO corporation, Houston, Tex.).

In some embodiments, centrifuge 308 may separate drill cuttings fraction 312 and second effluent 310 based upon density. Drill cuttings and industrial carbon or graphite may have different densities, ranging from slightly different to vastly different depending upon the strata being drilled. Density gradient centrifugation may advantageously be used to separate the drill cuttings from second effluent based upon density, minimizing the amount of drilled solids in second effluent 310. Float-sink separations may also be employed to separate the components based upon density.

In other embodiments, centrifuge 308 may separate second drill cuttings fraction 312 having an average particle size of 2000 microns and greater from first effluent 306 in some embodiments; 1000 microns or greater in other embodiments; 500 microns or greater in other embodiments; 400 microns or greater in other embodiments; 250 microns or greater in yet other embodiments. In some embodiments, centrifuge 308 may separate a second drill cuttings fraction 312 including drill cuttings and other similarly sized drilling mud components from combined first effluent 306, and where at least a fraction of the industrial carbon may remain with second effluent 310.

In certain embodiments, centrifuge 308 may provide a G-force of up to 200 G's up to 400 G's in other embodiments; up to 600 or more G's in yet other embodiments. In certain embodiments, the G-force applied by the centrifuge may vary along the length of the basket or screen. In other embodiments, centrifuge 308 may provide a screen having a mesh size between 10 and 100 mesh; between 15 and 75 mesh in other embodiments; and from 20 to 65 mesh in yet other embodiments.

Second effluent 310 may be subsequently fed to tank 311, and then pumped to hydrocyclone shaker 314 using pumps 315*a*, 315*b*. Industrial carbon fraction 316 may be separated from third effluent 318 in hydrocyclone shaker 314. Second effluent 310 may be optionally diluted with an internal olefin stream 313, either in a transfer line or within tank 311. Internal olefin stream 313 may be used to lower the viscosity of second effluent 310, potentially enhancing the separations achieved in hydrocyclone shaker 314.

In some embodiments, hydrocyclone shaker 314 may separate an industrial carbon fraction 316 having an average particle size of 500 microns or greater; 250 microns or greater in other embodiments; 75 microns or greater in other embodiments; 2 microns or greater in yet other embodiments. In other embodiments, hydrocyclone shaker 314 may separate an industrial carbon fraction 316, which may include industrial carbon and other particles of similar size, from second effluent 310. Smaller particles, such as clay and other additives, may remain suspended in third effluent 318.

In certain embodiments, hydrocyclone shaker 314 may include one or more hydrocyclones having a hydrocyclone diameter of at least 10 cm (4 inches). In other embodiments, hydrocyclone shaker may have a hydrocyclone diameter from 0.4 to 27.5 cm (1 to 18 inches). The hydrocyclone may have a constant or adjustable apex ranging size from 0.6 to 1.55 cm (about ¼ inch to about ⅝ inch). Hydrocyclone shaker 314 may also include one or more shakers having elliptical or linear motion capabilities. Hydrocyclone shaker 314 may include a shaker having screens ranging in size from 50 to 300 mesh; from 70 to 175 mesh in other embodiments; and from 80 to 120 mesh in yet other embodiments. In some embodiments, the shaker may include one or more screens which are at the same or different angles ranging from 1 to 10 degrees from horizontal.

In embodiments, industrial carbon fraction 316 may be at least 50 weight percent industrial carbon. In other embodiments, industrial carbon fraction 316 may be at least 70 weight percent industrial carbon; at least 80 percent in other embodiments; 90 weight percent in other embodiments; and 95 weight percent in yet other embodiments. Industrial carbon fraction 316, which can include industrial carbon and other particles of similar size, may be recycled to the mud system 317, as needed, or can undergo further processing as described below.

Third effluent 318 can be recovered in tank 319, which can be an independent vessel or a portion of a partitioned vessel which may allow overflow into or from tank 311. Third effluent 318 may be further processed to recover smaller particles, such as barite, polymer beads, or other additives using additional separation process 320. For example, third effluent 318 can be fed to one or more additional separators using pump 321. Barite 322 may be recovered in centrifuge 323; sand and silt 326 may be separated from clean drilling fluid 328 in centrifuge 329. Clay 322, clean fluid 328 and any other additives recovered from additional separation process 320 can be recycled to the mud system 317, as needed for control of mud properties such as weight and viscosity, among others. Sand and silt 326 can be combined with first and second particle fractions 304, 312 for disposal, further processing, or other various end uses, as described above. Holding vessels or compartments 332, 334, 336, as well as pumps 338, 340, 342 may also be used to facilitate separation process 320.

The industrial carbon fraction recovered by any of the above processes can be recycled to a mud system. Alternatively, the industrial carbon fraction can undergo further separations prior to recycle, forming at least one fraction of enhanced industrial carbon content. As used herein, a fraction having enhanced industrial carbon content is defined as having a higher weight percent industrial carbon than the industrial carbon fraction prior to undergoing further separations. One or more of such streams having enhanced industrial carbon content may be recycled to the mud system as needed.

For example, as one alternative, the industrial carbon fraction can undergo one or more screen separations, isolating particles of discrete size ranges. The discrete size ranges having an undesirable amount of drill cuttings may be discarded, and the discrete size ranges having acceptable concentrations of industrial carbon may be recycled to the mud system. As another alternative, the industrial carbon fraction may undergo one or more density separations, isolating particles of discrete density ranges, further separating the industrial carbon from the drill cuttings prior to recycle. For example, drill cuttings may have a density average of approximately 2.6 g/cc, typically ranging from 2 g/cc to 8 g/cc or more, whereas industrial carbon may have a density of approximately 2.1 g/cc, typically ranging anywhere from 1 g/cc to 2.5 g/cc. This difference in density may allow float-sink, centrifugal, or other density or density gradient separation methods to separate the industrial carbon from the heavier drill cuttings. In either of these manners the amount of drill cuttings recycled to, and potentially building up in, the mud system can be minimized.

Due to the variations in formations encountered during drilling operations, the efficiency of the industrial carbon recovery process may vary. To account for variations in the drilling mud compositions and the sizes of particles returning to the surface, the screen mesh sizes or other variables affecting particle separations can be adjusted as needed to maintain a desired degree of industrial carbon separation and recovery.

Drilling mud fed to the wellbore, or that coming from the wellbore can have up to 5 pounds per barrel (ppb) industrial carbon in some embodiments; up to 10 ppb in other embodiments; up to 15 ppb or greater in yet other embodiments. In embodiments of the process for the separation of industrial carbon from drilling fluids, 50 weight percent or more of the industrial carbon returning with the drilling mud from the wellbore can be recovered in the industrial carbon fraction; 65 weight percent or more in other embodiments; 75 percent or more in other embodiments; 85 percent or more in other embodiments 90 percent or more in yet other embodiments.

EXAMPLES

Samples from two different drilling operations were collected and analyzed to determine where in the process the industrial carbon was being discarded. Although these samples reflect only one or two types of strata encountered during drilling, the analyses of the samples indicate that a size or density separation may be used to sufficiently isolate the industrial carbon for recycle to an active mud system.

Sample 1: Industrial carbon (G-SEAL®, available from MI-SWACO, Houston, Tex.; average particle size of 450 microns, particle diameters ranging from 200-600 microns) was used as an additive in drilling mud during drilling operations. During mud cleaning operations, drilling mud containing drill cuttings and industrial carbon was separated, using shakers having sequentially larger mesh sizes as shown in Table 1. The drilling mud Sample 1 was initially separated in 10 and 40 mesh shakers. The effluent from the 40 mesh shaker was then separated in parallel across screens ranging in size from 84 to 175 mesh. The total flow was 935 gpm separated between the four shakers. Samples of the particles recovered in each screen were collected. The solids recovered during each separation stage were then visually analyzed to determine the approximate concentration of industrial carbon within the recovered samples.

Figure 5:
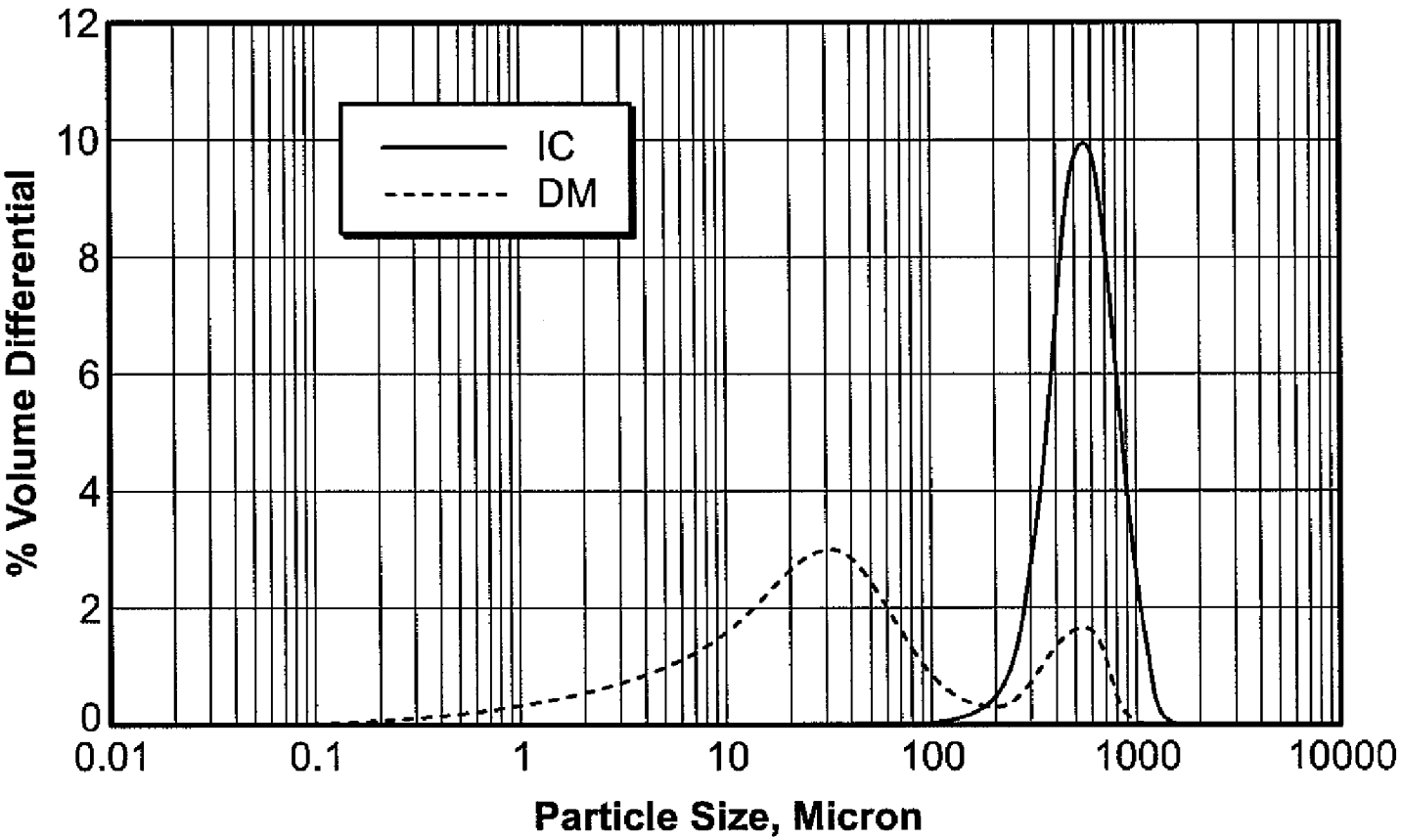
FIG. 5 is a graphical illustration of the particle size distribution of industrial carbon sample and solids recovered from a sample collected from a mud cleaning system.

Sample 2: Industrial carbon (G-SEAL®, available from MI-SWACO, Houston, Tex.) was used as an additive in drilling mud during drilling operations. Drilling mud containing drill cuttings and industrial carbon was collected from a flowline sample point after a MUD™-10 centrifuge and prior to further mud cleaning operations. The initial particle size distribution of the G-SEAL® ("IC") added to the mud system and the particle size distribution of the drillng mud sample ("DM") are shown in FIG. 5. The industrial carbon had an average particle size diameter of approximately 650 microns, with particles ranging in size from 150 to 1500 microns. Sample 2 was initially separated in a 40 mesh shaker. The effluent from the 40 mesh shaker was then separated using shakers (84 mesh and 110 mesh) and mudcleaners in parallel, similar to the Sample 1 analyses. The solids recovered during each separation stage were then visually analyzed to determine the approximate concentration of industrial carbon within the recovered samples, with the results as shown in Table 1.

TABLE 1

Percent industrial carbon in recovered samples at various mesh sizes.

| | Sample 1 % Industrial Carbon in sample | Sample 2 % Industrial Carbon In sample |
|---|---|---|
| 10 Mesh Shaker (2000 micron) | 5 | |
| 40 Mesh Shaker (420 micron) | 50 | 40 |
| 84 Mesh Shaker (186 micron) | 75 | 64 |
| 110 Mesh Shaker (139 micron) | 95 | 96 |
| 140 Mesh Shaker (107 micron) | 95 | |
| 175 Mesh Shaker (85 micron) | 95 | |
| Mudcleaner Cones | | 50 |
| Mudcleaner Cones/210 Mesh (70 micron) | | 70 |

Figure 6A:
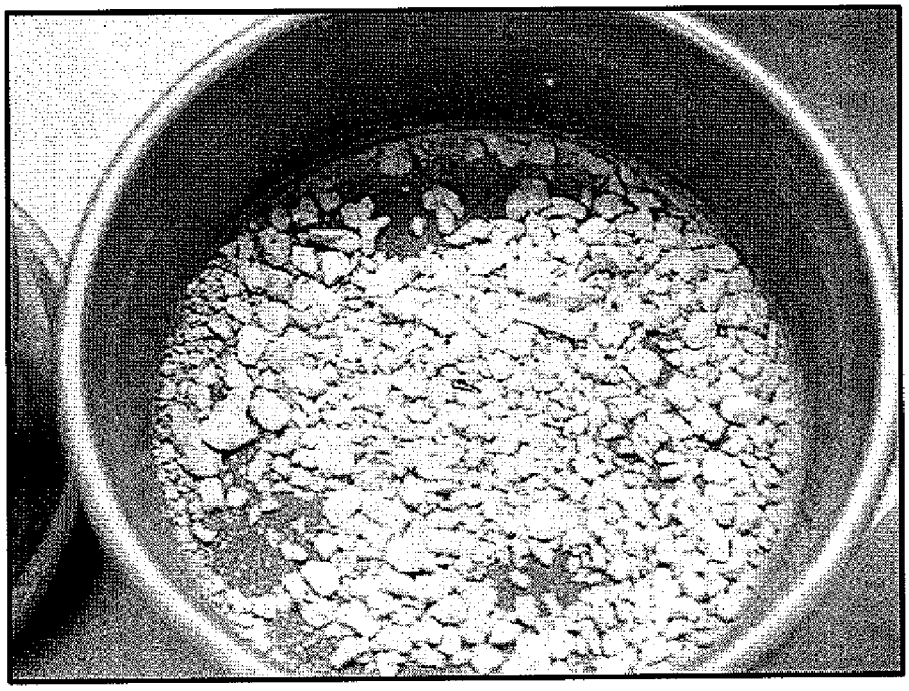
FIG. 6*a* is a picture of drill cuttings and other particles recovered from a drilling mud sample.

FIG. 6*a* is a picture of drill cuttings and other particles recovered from a drilling mud sample. The particles were recovered using a 10-mesh screen (2000 microns). Industrial carbon is dark in color (graphite). The color of the large particles recovered from the 10-mesh screen indicates very little industrial carbon.

Figure 6B:
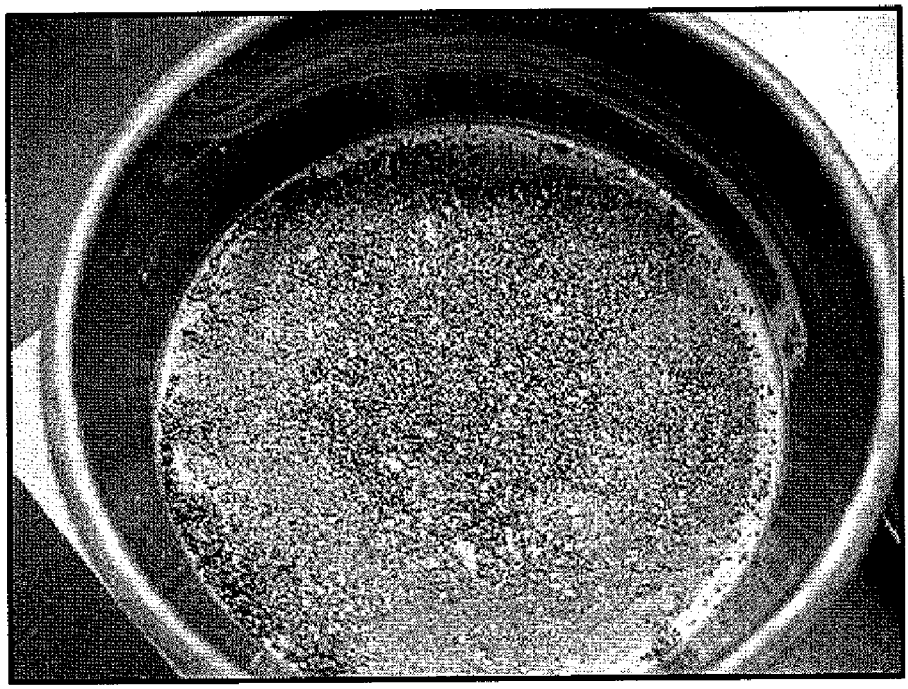
FIG. 6*b* is a picture of industrial graphite and other particles recovered from a drilling mud sample (darker material is industrial graphite)

FIG. 6*b*, on the other hand, is a picture of solids recovered from the effluent of the 10-mesh screen used to recover the large solids illustrated in FIG. 6*a*. The industrial graphite, darker in color, appears to be a majority of the solids collected from the effluent sample, in the range of 90% industrial carbon based on visual observation.

Figure 7:
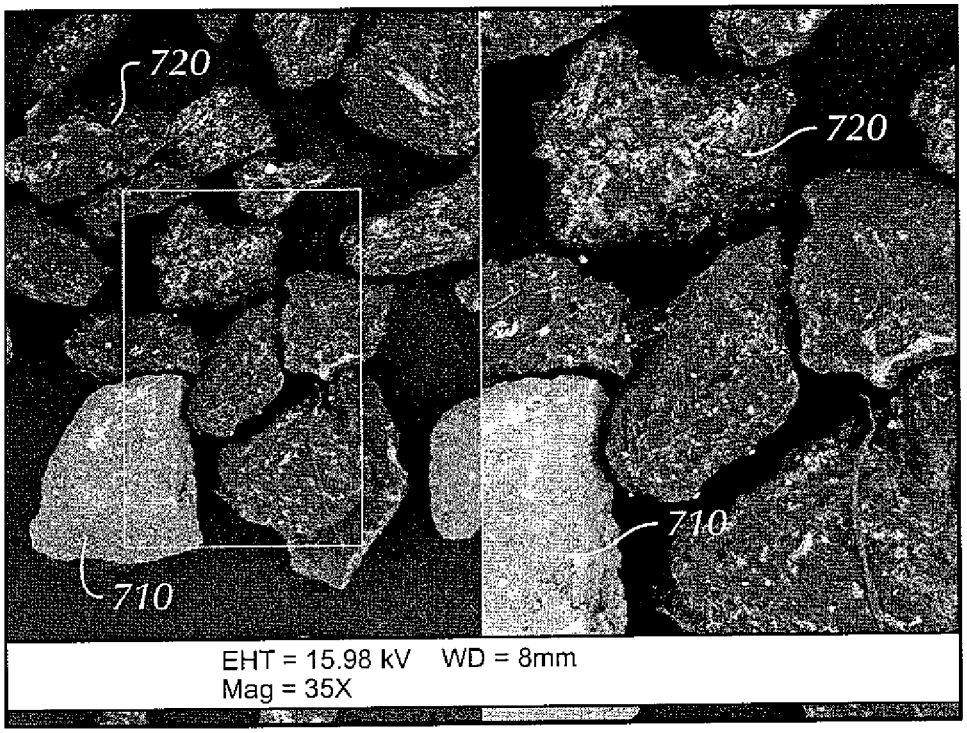
FIG. 7 is a dual magnification image illustrating details of drill cuttings (light gray particle) and industrial graphite (darker elements).

As mentioned above, the industrial carbon materials are commonly supplied as particles, of varying particle sizes, uniformity, and shape, and the drill cuttings and formations encountered during drilling often return particles of a similar shape and size, thus increasing the difficulty of industrial carbon recovery. FIG. 7 is a dual magnification image illustrating details of drill cuttings (light gray particle, 710) and industrial graphite (darker elements, 720), as recovered during the separations performed on Sample 2. FIG. 7 shows the similarity in size of industrial carbon to drill cuttings, illustrating the inherent difficulty in obtaining a complete separation or recovery of the industrial carbon.

For both Sample 1 and Sample 2, approximately 90-95 percent of the particles collected with screens having greater than 100 mesh were industrial carbon. The 84-mesh screen resulted in a sample having between 60 and 80 percent industrial carbon. In this example, an 84-mesh screen could adequately recover the industrial carbon with an acceptable amount of drill cuttings carryover. The 110-mesh screen may have had a significantly higher percentage of industrial carbon due to the series-type separations.

Figure 8:
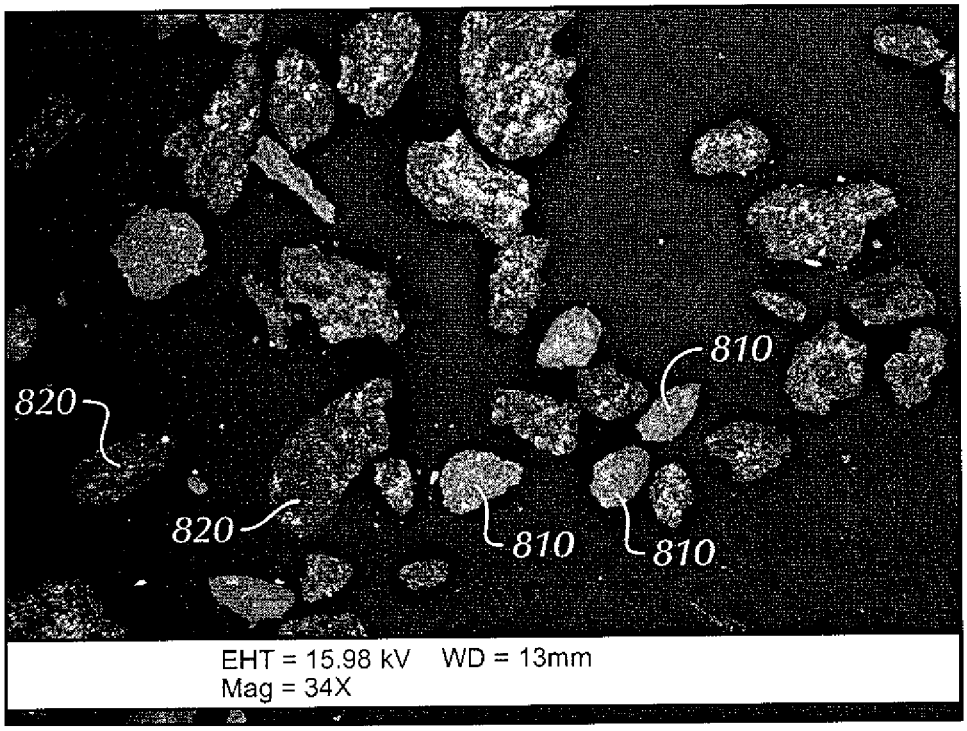
FIG. 8 is an image of particles recovered from an 84-mesh screen.

FIG. 8 is an image of particles recovered from an 84-mesh screen during the separations performed on Sample 2. The particles recovered again included drill cuttings (light gray particles, 810) and industrial carbon (darker particles, 820). Visual analyses indicated that particles recovered using an 84-mesh screen had a relative abundance of industrial carbon of approximately 64 weight percent. Analysis of the particle size indicated that the sizes of particles ranged from 150 to 400 microns, with an average particle size recovered of approximately 200 microns.

Figure 9:
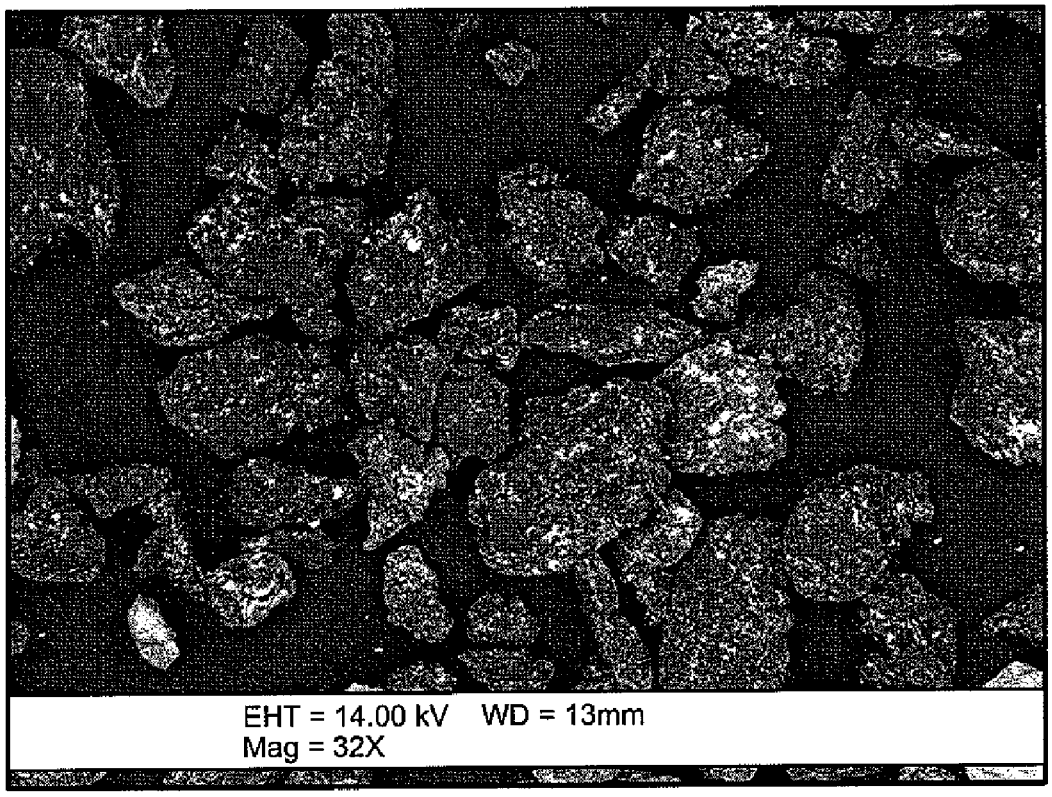
FIG. 9 is an image of particles recovered from a 110-mesh screen.

FIG. 9 is an image of particles recovered from a 110-mesh screen during the separations performed on Sample 2. Visual analyses indicated that particles recovered using a 110-mesh screen had a relative abundance of industrial carbon of approximately 96 weight percent. Analysis of the particle size indicated that the sizes of particles ranged from 150 to 500 microns, with an average particle size recovered of approximately 300 microns.

The specific cut point(s) used during separations can influence both the ability to recover and recycle the industrial carbon with minimal build-up of drill cuttings, and the economic incentive to recycle. Where only one separation step is performed isolating the industrial carbon fraction, it may be preferred to use a screen having between an 84-mesh and a 150-mesh, or a larger mesh number, depending upon the industrial carbon particle size, drill cutting particle size, and the amount of drill particles recovered that can be recycled without significant build-up in the mud system. In a series-type separation scheme, it may be preferred to use screens of increasingly larger mesh numbers, where one or more fractions of industrial carbon recovered can be recycled, again depending upon the particle sizes and build-up concerns. In other embodiments, a screen number of less than 84 may be acceptable.

Advantageously, the present invention provides for a method to recover industrial carbon from drilling fluid. The recovered industrial carbon may be recycled to the drilling mud system, thereby improving the economics of the drilling process. Additionally, the recovery and reuse of industrial carbon may allow for increased usage of industrial carbon throughout the drilling cycle, potentially decreasing the amount of lost circulation events, and potentially contributing to enhanced wellbore stability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A process for the recovery of industrial carbon material from a mixture of materials, wherein the mixture comprises drilling fluids, drilled solids, and industrial carbon from a mud system, the process comprising:

separating at least a portion of the drilled solids from the mixture to form a first effluent and a drilled solids fraction;

separating at least a portion of the industrial carbon from the first effluent to form a second effluent and a recovered industrial carbon fraction;

separating at least a portion of the recovered industrial carbon fraction to form at least one fraction of enhanced industrial carbon content; and recycling at least a portion of the recovered industrial carbon to the mud system.

2. The process of claim 1, comprising diluting the first effluent with an internal olefin.

3. The process of claim 1, wherein the mixture further comprises weighting materials, the process further comprising separating at least a portion of the weighting materials from the second effluent to form a weighting material fraction and a third effluent.

4. The process of claim 3, comprising recycling at least a portion of the weighting material fraction to the mud system.

5. The process of claim 3, comprising recycling at least a portion of the third effluent to the mud system.

6. The process of claim 1, wherein the industrial carbon fraction comprises at least 60 weight percent industrial carbon.

7. The process of claim 1, wherein the separating at least a portion of the drilled solids is performed in an apparatus selected from the group consisting of screen separators, hydrocyclones, desilters, desanders, mud cleaners, mud conditioners, dryers, drying shakers, centrifuges, hydrocyclone shakers, and combinations thereof.

8. The process of claim 1, wherein the separating at least a portion of the industrial carbon is performed in an apparatus selected from the group consisting of screen separators, hydrocyclones, desilters, desanders, mud cleaners, mud conditioners, dryers, drying shakers, centrifuges, hydrocyclone shakers, and combinations thereof.

9. The process of claim 1, wherein the separating at least a portion of the recovered industrial carbon fraction to form at least one fraction of enhanced industrial carbon content comprises processing the industrial carbon fraction in a centrifuge.

10. A process for the recovery of industrial carbon from a mixture of materials, wherein the mixture comprises drilling fluids, drilled solids, and industrial carbon from a mud system, the process comprising separating a first portion of the drilled solids from the mixture to form a first effluent and a drilled solids fraction;

separating a second portion of the drilled solids from the first effluent to form a second effluent and a second drilled solids fraction;

separating at least a portion of the industrial carbon from the second effluent to form a third effluent and a recovered industrial carbon fraction;

separating at least a portion of the recovered industrial carbon fraction to form at least one fraction of enhanced industrial carbon content; and recycling at least a portion of the recovered industrial carbon to the active mud system.

11. The process of claim 10, comprising diluting the second effluent with an internal olefin.

12. The process of claim 10, wherein the mixture further comprises weighting materials, the process further comprising separating at least a portion of the weighting materials from the third effluent to form a weighting material fraction and a fourth effluent.

13. The process of claim 12, comprising recycling at least a portion of the weighting material fraction to the active mud system.

14. The process of claim 10, wherein the industrial carbon fraction comprises at least 60 weight percent industrial carbon.

15. The process of claim 14, wherein the industrial carbon fraction comprises at least 80 weight percent industrial carbon.

16. The process of claim 15, wherein the industrial carbon fraction comprises at least 90 weight percent industrial carbon.

17. The process of claim 10, wherein the separating a second portion of drilled solids is performed in an apparatus selected from screen separators, hydrocyclone, desilter, desander, mud cleaner, mud conditioner, dryer, drying shaker, centrifuge, hydrocyclone shaker, and combinations thereof.

18. The process of claim 10, wherein the separating at least a portion of the industrial carbon is performed in an apparatus selected from screen separators, hydrocyclone, desilter, desander, mud cleaner, mud conditioner, dryer, drying shaker, centrifuge, hydrocyclone shaker, and combinations thereof.

19. The process of claim 10, wherein the first drilled solids fraction comprises particles having an average particle size of 2000 microns or greater.

20. The process of claim 10, wherein the second drilled solids fraction comprises particles having an average particle size of 1000 microns or greater.

21. The process of claim 10, wherein the industrial carbon fraction comprises particles having an average particle size in the range of 75 to 1000 microns.

22. The process of claim 10, wherein the mixture comprises from 0.1 to 15 pounds industrial carbon per barrel, and wherein 50 weight percent or more of the industrial carbon in the mixture is recovered in the industrial carbon fraction.

23. The process of claim 10, wherein the separating at least a portion of the recovered industrial carbon fraction to form at least one fraction of enhanced industrial carbon content comprises processing the industrial carbon fraction in a centrifuge.

* * * * *

UNITED STATES PATENT AND TRADEMARK OFFICE

CERTIFICATE OF CORRECTION

PATENT NO. : 7,438,142 B2
APPLICATION NO. : 11/387442
DATED : October 21, 2008
INVENTOR(S) : Frank Butler et al.

It is certified that error appears in the above-identified patent and that said Letters Patent is hereby corrected as shown below:

On the Title Page, item (75) Inventors, line 1, the first Inventor's city of residence "Houston" should be --Lafayette--.

Signed and Sealed this

Thirteenth Day of January, 2009

JON W. DUDAS
*Director of the United States Patent and Trademark Office*